US011186406B2

(12) United States Patent
Chapman et al.

(10) Patent No.: US 11,186,406 B2
(45) Date of Patent: Nov. 30, 2021

(54) TAMPER EVIDENT LOCKING FOLDED BOX

(71) Applicant: Southern Champion Tray, L.P., Chattanooga, TN (US)

(72) Inventors: David Chapman, Chattanooga, TN (US); Neha Mardi, Chattanooga, TN (US); Benjamin Walter, Chattanooga, TN (US); Pascale Grenier, Chattanooga, TN (US)

(73) Assignee: Southern Champion Tray L.P., Chattanooga, TN (US)

( * ) Notice: Subject to any disclaimer, the term of this patent is extended or adjusted under 35 U.S.C. 154(b) by 0 days.

(21) Appl. No.: 16/374,256

(22) Filed: Apr. 3, 2019

(65) Prior Publication Data

US 2019/0300232 A1 Oct. 3, 2019

Related U.S. Application Data

(60) Provisional application No. 62/651,873, filed on Apr. 3, 2018.

(51) Int. Cl.
*B65D 5/66* (2006.01)

(52) U.S. Cl.
CPC ..... *B65D 5/6608* (2013.01); *B65D 5/667* (2013.01)

(58) Field of Classification Search
CPC .. B65D 5/0085; B65D 5/4287; B65D 5/6608; B65D 5/106; B65D 5/0254; B65D 5/2057; B65D 2571/0015; B65D 5/667
USPC ..... 229/102, 125.28–125.29, 125.32, 132, 229/149, 153, 155, 188, 195, 247
See application file for complete search history.

(56) References Cited

U.S. PATENT DOCUMENTS

| | | | | | |
|---|---|---|---|---|---|
| 636,806 | A | | 11/1899 | Johnstone | |
| 838,964 | A | * | 12/1906 | Dobson et al. | B65D 27/22 229/84 |
| 1,108,464 | A | * | 8/1914 | Morey | B65D 5/0254 229/102 |
| 1,277,459 | A | * | 9/1918 | Myers | B65D 5/6661 229/148 |
| 3,018,029 | A | * | 1/1962 | Fellowes | B65D 5/106 229/156 |
| 3,037,684 | A | | 6/1962 | Andrews | |
| 3,403,839 | A | | 10/1968 | Farquhar | |
| 3,462,066 | A | * | 8/1969 | Farquhar | B65D 5/106 229/102 |
| 3,780,934 | A | * | 12/1973 | Gardner | B65D 5/46112 229/117.15 |
| 3,949,931 | A | * | 4/1976 | Hall | B65D 5/22 229/102 |
| 4,063,678 | A | * | 12/1977 | Hall | B65D 5/106 229/102 |

(Continued)

FOREIGN PATENT DOCUMENTS

| | | | | |
|---|---|---|---|---|
| DE | 19809466 A1 | | 9/1999 | |
| DE | 10046179 A1 | * | 5/2001 | B65D 5/5405 |

(Continued)

*Primary Examiner* — Nathan J Newhouse
*Assistant Examiner* — Phillip D Schmidt
(74) *Attorney, Agent, or Firm* — Miller & Martin PLLC

(57) ABSTRACT

A tamper resistant latching mechanism is provided with an insert tab and wings on a first section used in conjunction with a slot and release panel on an opposite hingedly connected section.

12 Claims, 8 Drawing Sheets

(56) References Cited

U.S. PATENT DOCUMENTS 4,516,718 A * 5/1985 Forbes, Jr. ..... B65D 5/68 229/146
4,763,832 A * 8/1988 Forbes, Jr. ..... B65D 5/667 229/114
4,830,270 A 5/1989 Holmes
4,844,330 A * 7/1989 Roosa ..... B65D 5/48024 229/120.06
5,039,003 A * 8/1991 Gordon ..... B65D 25/08 229/120.32
5,207,374 A 5/1993 Lo Duca
5,467,916 A * 11/1995 Beales ..... B65D 5/3657 229/117.07
5,507,428 A * 4/1996 Robinson, Jr. ..... B65D 5/0254 229/102
5,520,284 A * 5/1996 Gray ..... B65D 5/46024 206/509
5,803,345 A 9/1998 Jones
5,878,948 A 3/1999 Schultz
6,223,979 B1 * 5/2001 Correll ..... B65D 5/6655 229/114
6,860,421 B2 3/2005 Lo Duca
8,142,075 B2 3/2012 Shaw
8,142,076 B2 3/2012 Shaw
8,408,451 B2 4/2013 Adam
D744,829 S 12/2015 Deering
9,573,719 B2 2/2017 Deering
9,928,757 B2 3/2018 Huffer
10,099,812 B2 10/2018 Shaw
10,138,026 B2 11/2018 Branyon
10,150,600 B2 12/2018 Huffer
2006/0124708 A1 6/2006 Lo Duca
2008/0302808 A1 * 12/2008 Maxwell ..... B65D 5/4295 220/810
2009/0072015 A1 * 3/2009 Drew ..... B65D 5/0209 229/102
2014/0263600 A1 * 9/2014 Valencia ..... B65D 5/244 229/155
2016/0052222 A1 * 2/2016 Kinney ..... B65D 5/2057 229/126
2016/0214760 A1 7/2016 Takeuchi
2017/0259953 A1 9/2017 Bressan

FOREIGN PATENT DOCUMENTS

DE 10046179 A1 5/2001
EP 1348633 A1 * 10/2003 ..... B65D 5/32
EP 2003061 A1 12/2008
EP 2805895 A1 11/2014
EP 3461756 A1 4/2019
GB 2198708 A 6/1988
GB 2251600 A 7/1992
WO WO2015140704 A1 9/2015

* cited by examiner

TAMPER EVIDENT LOCKING FOLDED BOX

The present invention claims priority to U.S. Provisional Application Ser. No. 62/651,873 filed Apr. 3, 2018.

FIELD OF THE INVENTION

The invention relates to a tamper evident locking mechanism for use on folding containers, preferably fabricated from a unitary paperboard stock, and providing re-latching functionality.

BACKGROUND OF THE INVENTION

In the food packing industry, and particularly the freshly prepared food packaging industry, there is a continual need for improved packaging systems. Various types of freshly prepared food items present diverse requirements that may range from leak-resistance to temperature stability, or as addressed in present example, locking and safety concerns.

Food delivery is a growing segment of the current restaurant/bakery food preparation business model. This is evidenced not only by the promotions of the food preparation businesses, but also by the number of businesses entering the freshly prepared food delivery space including Uber Eats, Grub Hub, Doordash, Waitr, and others. The present estimates are that this segment of the prepared food business is now in excess of one billion dollars annually and the segment is growing rapidly. Food delivery is premised upon consumers' reliance both upon the restaurant, bakery, or other freshly prepared food outlet and also upon the delivery service. To this end, some food delivery systems utilize automated delivery robots with locking compartments that can only be accessed utilizing a code transmitted to the consumer. Alternatively, packaging may be sealed with various tapes and adhesives so that any opening of a food container is obvious by damaging the seal or packaging.

The use of locked compartment delivery robots, or even the additional steps and materials required to create a sealed package, incur additional time and cost in the food preparation and delivery process. Historically, paperboard food packaging has been offered for customer carryout from restaurants and other businesses purveying freshly prepared food, and this has provided an economical solution. When the end customer does not deal directly with the food preparer, additional concerns with food safety and tampering are introduced. Previously paperboard and similar foldable substrate packaging has not contained technology that demonstrates when tampering has occurred, while still permitting a latching mechanism to be reused.

Paperboard food packaging can provide a very economical packaging system for food preparation businesses. In light of the number of consumers that would order more frequently through food delivery services if they were assured their food was unchanged from leaving the restaurant or food preparation business, tamper evident packaging is a key business concern. Restaurants that can provide effective tamper-evident packaging will enjoy a competitive advantage. Freshly prepared food businesses will also achieve significant economies if the same packaging is effective for both is store sales and for deliveries. In addition, food delivery services face potential liability and harm to their businesses should food tampering occur. Allowing end users the ability to understand from rapid visual inspection whether food has been tampered with, can manage safety perceptions of food delivery and quality of service.

Accordingly, there is a need for inexpensive tamper evident packaging suitable for use in food delivery services. It is also desirable that the packaging not be sealed in such a fashion that its utility is destroyed by opening and instead will still maintains its packaging functionality for further use if the entire food delivery is not immediately consumed.

SUMMARY OF THE INVENTION

Accordingly, the invention provides a latching mechanism that provides an obvious indication of tampering and that can be formed from a unitary folding blank. In one exemplary embodiment, the invention may be deployed on a paperboard clamshell container with leak-resistant gussets and may be reclosed and latched by an end user after opening. The invention may also be adapted to use on other folding containers, preferably made from a unitary blank and having a hingedly connected top section folding over a bottom tray section with perimeter walls.

DETAILED DESCRIPTION OF THE INVENTION

Figure 1A:
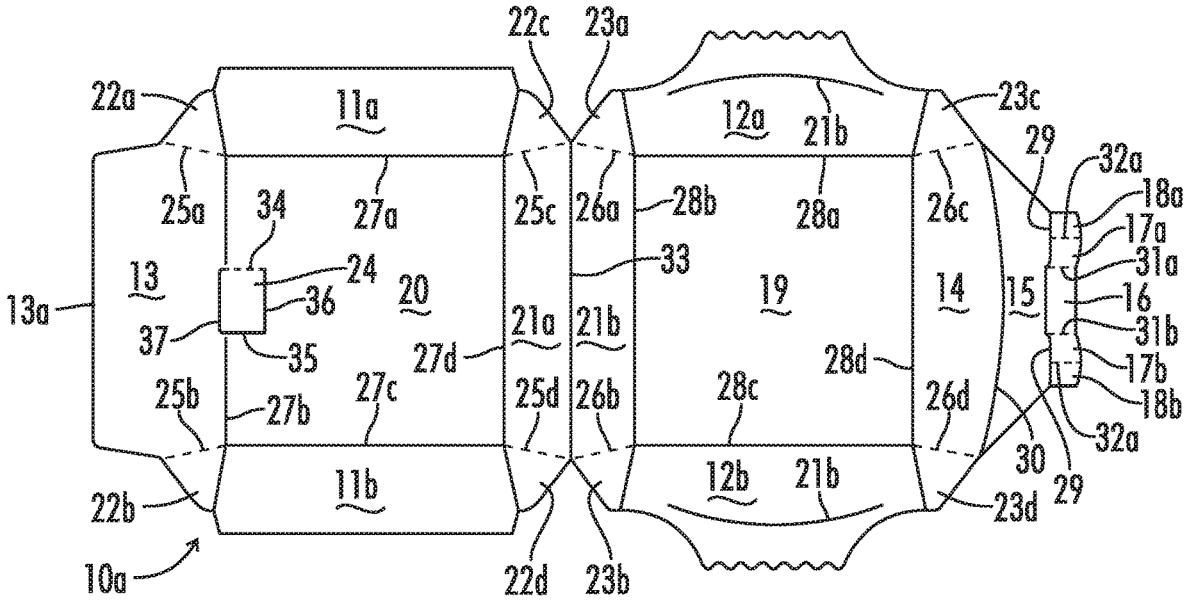
FIG. 1A is a top plan view of an exemplary unitary blank for a clamshell container prior to folding encompassing the invention.
Figure 1B:
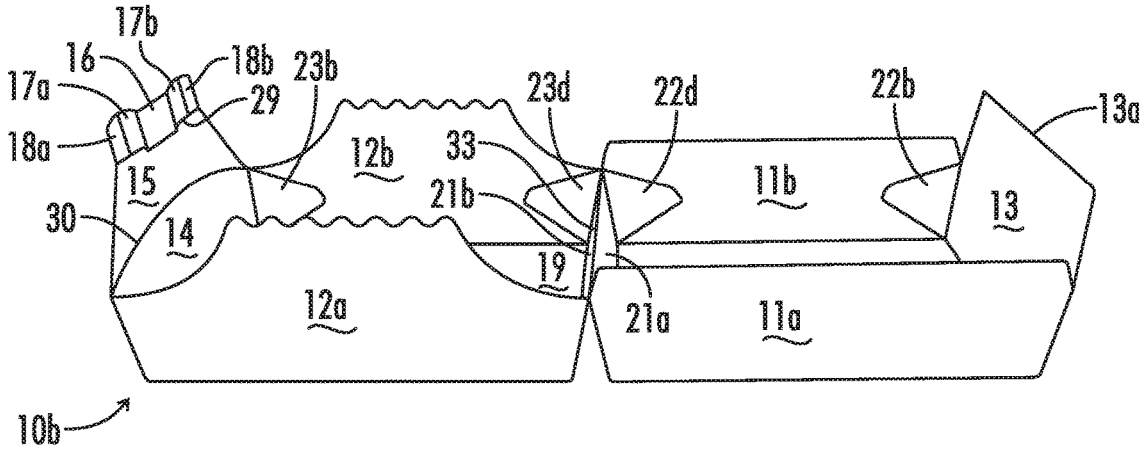
FIG. 1B is a perspective side view of a clamshell formed from the unitary blank of FIG. 1A.
Figure 2:
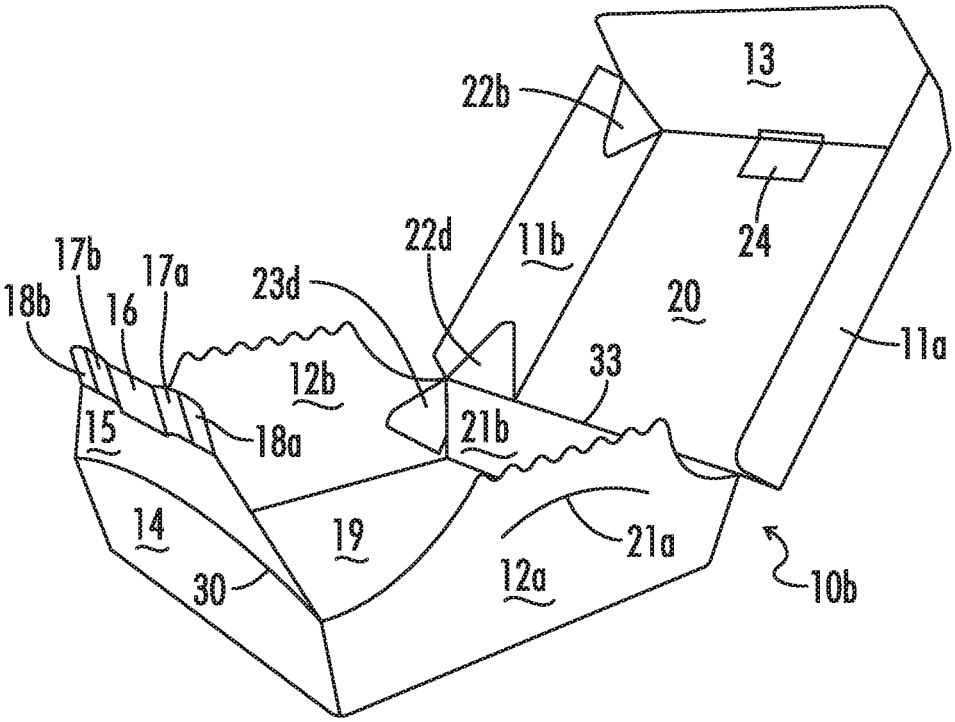
FIG. 2 is a perspective view of the clamshell container of FIG. 1B with the top or crown portion raised.
Figure 3:
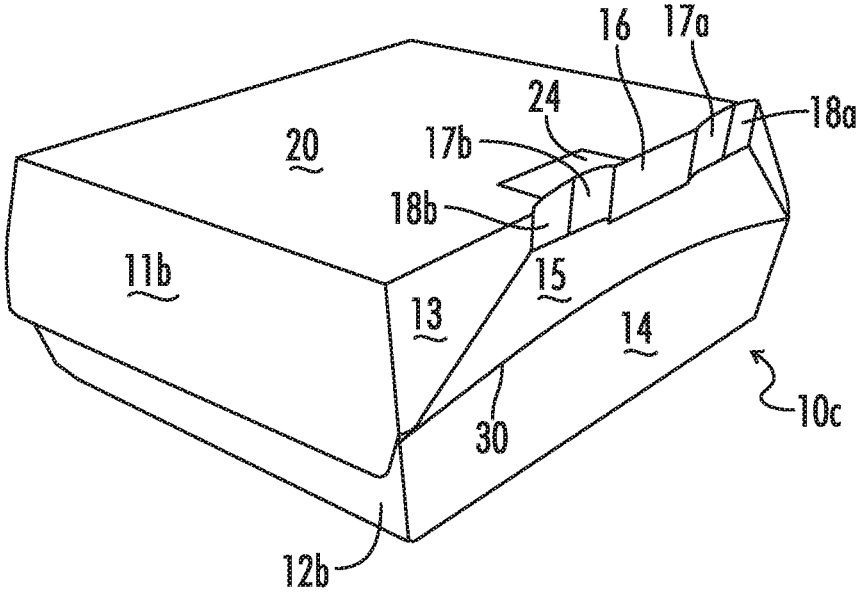
FIG. 3 is a perspective view of the clamshell container of FIG. 2 in its closed position, prior to utilizing the latching mechanism.

Referring to FIGS. 1 through 4, one embodiment of the invention is depicted in use on a clamshell container 10 that is illustrated in the form of a unitary blank 10*a* in FIG. 1A and assembled in FIG. 1B as clamshell 10*b* and closed clamshell 10*c* in FIG. 3. Most commonly, the unitary blank is made of paperboard and may have various coatings depending upon the particular end use to which it is directed. For instance, interior coatings may increase resistance to heat or liquid contents, and exterior coatings may facilitate printing graphics on the container. Other foldable substrate materials may also be suitable to particular end uses.

In the blank 10*a* of FIG. 1A, it can be seen that the clamshell has a base portion to the right of crease line 33 and a crown portion to the left of crease line 33. The base portion has a central rectangular bottom panel 19 defined by crease lines 28*a*-28*d*. Crease lines 28*a* and 28*c* define the connection of rectangular bottom 19 with ridged side panels 12*a*, 12*b*. Crease line 28*b* defines the fold between rectangular bottom 19 and back panel 21*b*. Crease line 28*d* defines the folding connection between rectangular bottom 19 and front panel 14. The ends of crease lines 28*b*, 28*d* are angled at about 10 degrees to properly shape the triangular corner sections 23*a*-*d*. On the ridged side panels 12*a*, 12*b*, crease lines 21*a*, 21*b* allow the ridged edges to flex. Dashed crease lines 26*a*-*d* cooperate with the ends of crease lines 28*b*, 28*d* to allow triangular panels 23*a*-*d* to be folded. Preferably, these triangular panels are folded inward to create interior gussets. In this fashion, triangular panels 23*a* and 23*c* can be adhesively joined to ridged sidewall 12*a* and triangular panels 23*b*, 23*d* can be adhesively joined to ridged sidewall 12*b*.

The front panel 14 has a top crease 30 that allows movement of the latch leg panel 15 that carries latching tab 16. Latching tab 16 has crease lines 31*a*, 31*b* separating foldable first wing sections 17*a*, 17*b*. Secondary creases 32*a*, 32*b* foldably separate first wing sections 17*a*, 17*b* from second wing sections 18*a*, 18*b*. Cut lines 29 between latch leg panel 15 and wing sections 17,18 allow wing sections to only be attached at crease lines 31,32.

The crown of the clamshell is constructed in a similar fashion with rectangular top panel 20 separated from side panels 11*a*, 11*b* by side folds or crease lines 27*a*, 27*c*. Top panel 20 is separated from back panel 21*a* by crease line 27*d* and separated from front panel 13 by crease line 27*b*. Front panel 13 extends from crease line 27*b* to an opposite distal edge 13*b*. Crease lines 27*b*, 27*d* angle outward at about 10 degrees at their end portions to define the desired shape of triangular sections 22*a*-*d*. An added feature of top panel 20 is the release panel 24, which may also be referred to as a tear tab. Release panel 24 is defined by a fold line 36 where it is securely but foldably attached to rectangular top 20. At the opposite side of release panel 24 is cut line 37 that defines a slot 41 (shown in FIG. 4C) along the fold line 27*b* between front panel 13 and top panel 20. Perforation lines 34, 35 along the sides of release panel 24 allow for the release panel to be pulled open and folded along crease 36 at the rear of panel 24 when it is desired to unlatch the container.

Triangular panels 22*a*-22*d* are also used to form the crown with triangular sections 22*b*, 22*d* folded along crease lines 25*b*, 25*d* inward to be adhesively attached to side panel 11*b*, and triangular panels 22*a*, 22*c* folded inward along crease lines 25*a*, 25*c* to be attached to side panel 11*a*. The structure of the assembled clamshell blank 10*b* with triangular panels attached to sidewalls is shown in FIG. 1B. It can be seen that the sidewalls 11, 12 and front walls 13, 14 and rear walls 21*a*, 21*b* are folded at angles so that they extend outward from the rectangular top and bottom panels 19, 20 at angles of approximately 100 degrees rather than extending vertically at 90 degrees. This outwardly expanding of both the tray and crown openings allows assembled clamshell boxes to be nested in the form of space saving stacks prior to use.

FIG. 1C shows the clamshell box 10*b* of FIG. 1B with the crown portion, including top panel 20, folded upward. FIG. 3 shows the clamshell 10*c* in its fully closed but still unlatched configuration. It can be seen in FIG. 3 that the ridged sidewalls 12*a*, 12*b* have folded interior crown sidewalls 11*a*, 11*b* with the creases 21*a*, 21*b* facilitating the bending of the upper ridged portions inward corresponding to the inward taper of sidewalls 11*a*, 11*b* as those sidewalls near the top panel 20.

It will also be understood that latch leg 15 is foldable along crease line 30 so that the attached central latch tab 16 can be moved toward and away from the rectangular top 20 as needed for latching. It can also be seen that the front wall 13 of crown portion of the clamshell fits so that its distal edge 13*a* is interior of the front wall 14 of the clamshell base. The result is a closed container with overlapping sidewalls 11, 12 and overlapping front walls 14, 13.

To operate the latching mechanism, the latch leg 15 is folded slightly away from the rectangular top panel 20 thereby providing space or clearance to assemble the latching tab. Latching tab consists of the insert tab 16 and one or more wings. In the illustrated embodiment of FIG. 4A, it can be seen at latching tab 16 has immediately adjacent wings 17*a*, 17*b* that fold along creases 31*a*, 31*b* on either side. Second wing segments 18*a*, 18*b* fold with respect to the first adjacent wing segments 17*a*, 17*b* along crease lines 32*a*, 32*b*. In an optimized configuration, the fold lines are manipulated so that secondary panels 18 and adjacent panels 17 form a Z shape (or mirrored Z-shape) with respect to the insert tab 16, as reflected in FIG. 4B. The wing panels are then compressed against the insert tab 16 as shown in FIG. 4C, so that effectively there is only a single insert tab shape that has no greater width than the insert tab 16 but may have additional thickness due to the additional layers of material from one or more folded wing elements, such as first and second segments 17*a*, 17*b* and 18*a*, 18*b*.

Figure 4A:
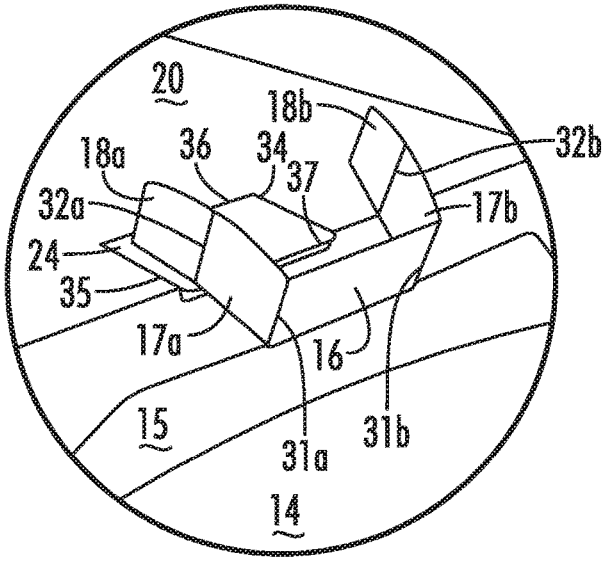
FIG. 4A is an exterior perspective view of the latching mechanism of the clamshell in FIGS. 1 through 3 in isolation.
Figure 4B:
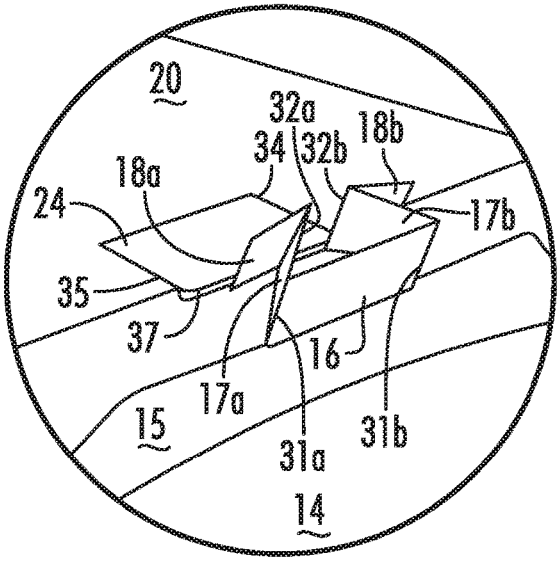
FIG. 4B is an exterior perspective view of the latching mechanism showing folding of the latching wings.
Figure 4C:
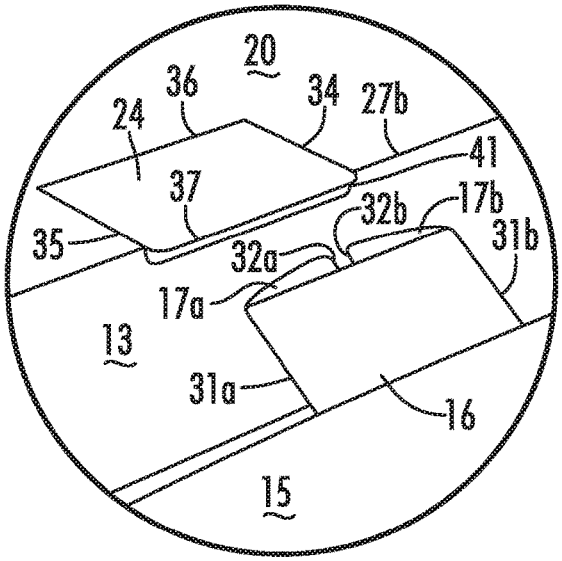
FIG. 4C is an exterior perspective view of the latching mechanism with the wings in a folded position.
Figure 4D:
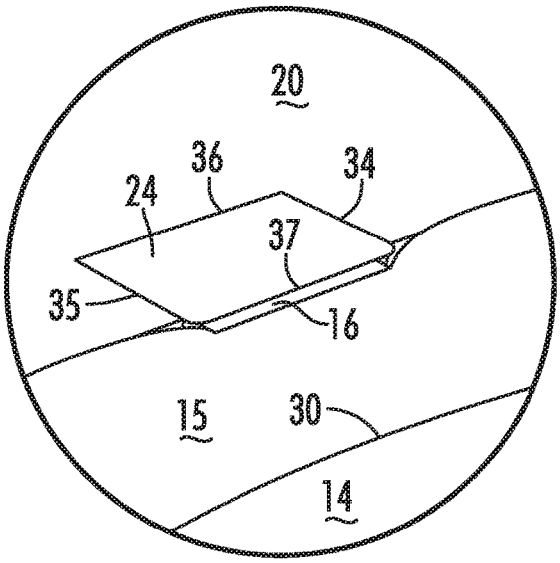
FIG. 4D is an exterior perspective view of the latching mechanism after it has been inserted into a top edge slot to latch the folding box.
Figure 4E:
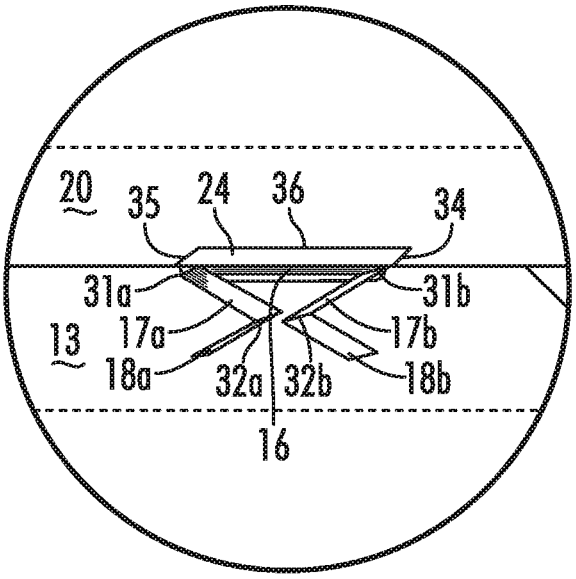
FIG. 4E is an interior perspective view of the latching mechanism showing the wings in partially unfolded state.

Turning then in particular to the release panel 24 shown in FIG. 4C, it can be seen that the cut line 37 at the front of release panel 24, and folding front panel 13 respective to top panel 20 creates a slot 41. The release panel or tear tab 24 is further defined by perforated sides 34, 35 and rear fold line 36. In operation, the insert tab 16 and associated wing elements are folded and inserted into slot 25 by pivoting latch leg 15 along crease line 30 into a forward position toward the top 20. As shown in FIG. 4E, once the insert tab 16 is interior of the slot 25, the wing sections 17, 18 begin to unfold and expand and form a locking or latching mechanism that prevents the front panel of the tray portion from disengaging from the front panel of the crown portion of the clamshell. The result is a simply latched clamshell container. However, the operation of release panel 24 creates a novel tamper resistant and reusable latching mechanism.

Figure 4F:
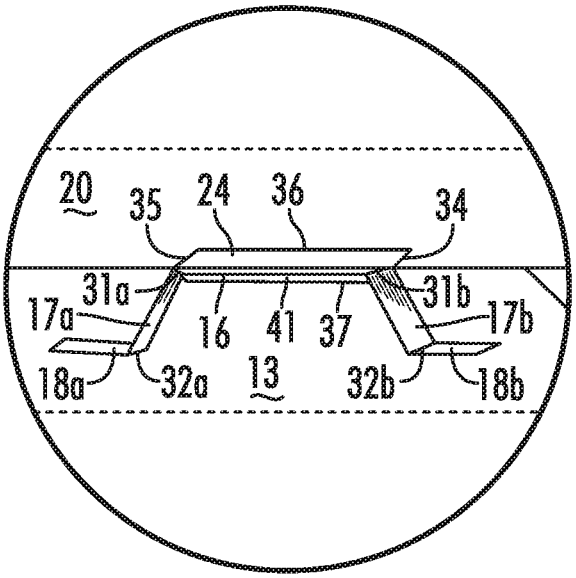
FIG. 4F is an interior perspective view of the container showing the wings of the latching tab further unfolded.

It can be seen from FIGS. 4E and 4F that the wing segments 17, 18 are not able to be withdrawn through the slot 41 that was created along cut line 37, since the wing segments cannot be accessed to be refolded and pressed against the latch tab 16 on the interior side of the assembled and latched container. This presents two possible avenues for opening the latched container, one by brute force and one by finesse.

The brute force method is to simply pull the front panel 14, and possibly latch leg 15 away from the crown portion. This action will tear the wings 17, 18 from the sides of insert tab 16, typically along crease lines 31*a*, 31*b* and depositing those paperboard wing elements into the food within the container. While this will accomplish the objective of demonstrating tampering with the clamshell container, it is also apparent that the latching mechanism is destroyed by this action and the food container will no longer remain latched. Accordingly, if the food container held a twelve slice cake and only four slices were consumed when the container was first opened, the end user is left with a less than optimal receptacle for the remaining eight slices of cake.

The second, and preferred, alternative for opening the latched food container is to utilize release panel 24 to expose the latch tab 16. To open the container in this fashion, the front of panel 24 (which may have a protruding lip) is lifted upward from the rectangular top 20. The release panel 24 will pivot from its rear edge along fold line 36 and tearing perforations 34, 35 defining the sides of the release panel 24. When the release panel 24 is folded upward to a nearly vertical position, the inserted latch tab 16 and its associated wing elements 17,18 can be accessed and removed through the larger rectangular opening that has been created. When this alternative is used, it is apparent that the packaging has been opened because the perforated sides 34, 35 of the release panel 24 have been torn. Even with perforated sides 34,35 being torn, however, the latching mechanism of latch tab 16 and its wing elements remains effective and the container can be reclosed by the consumer if, for instance, the food contents within are not completely consumed.

To provide optimal access to the latch tab 16, it is desirable that the length of perforations 34, 35 be slightly greater than the length of latch tab 16. This allows for a size of opening under the release tab 24 to permit latch tab 16 to be grasped and removed in a fashion that minimizes the likelihood of damaging the attachment of the wing elements 17,18.

Figure 5A:
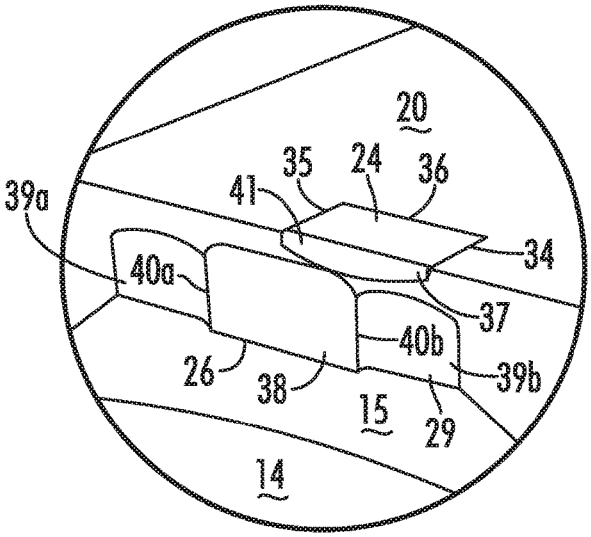
FIG. 5A is an isolation exterior perspective view of an alternative latching mechanism with only a single wing to each side of the latching tab.
Figure 5B:
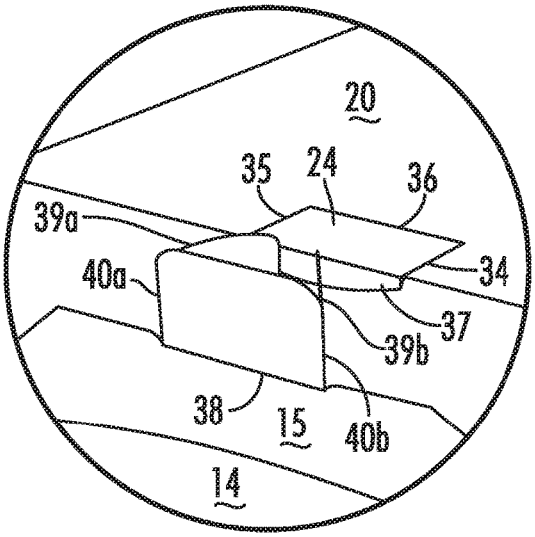
FIG. 5B is an exterior perspective view of the alternative latching mechanism of FIG. 5A with partially folded wings.
Figure 5C:
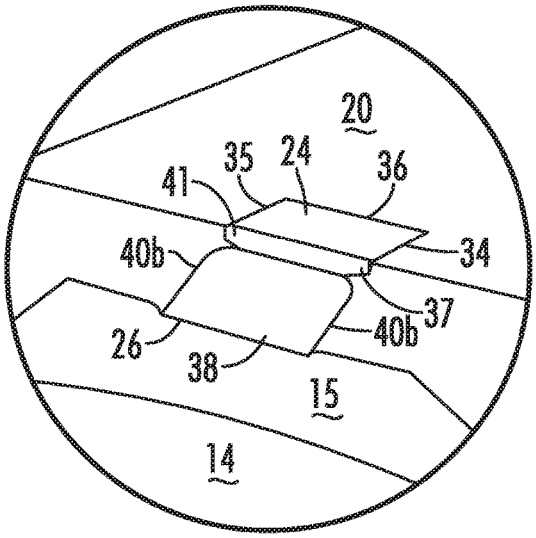
FIG. 5C is an exterior perspective view of the latching mechanism of FIG. 5A with wings folded against the latch tab.
Figure 5D:
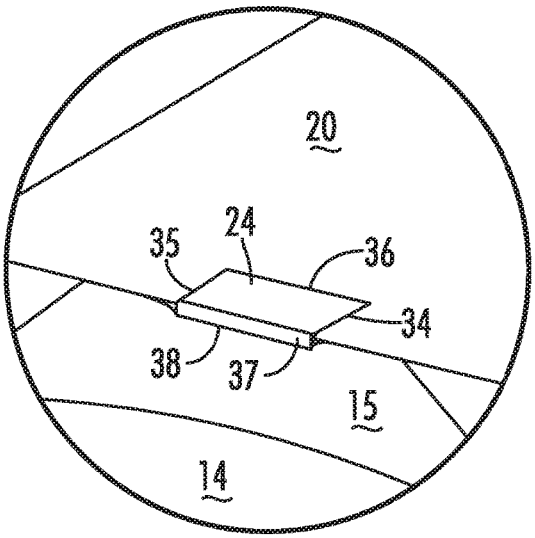
FIG. 5D is an exterior perspective view of the latching mechanism of FIG. 5A with latch tab and folded wings inserted into a top edge slot.

A simplified latch construction is illustrated in FIGS. 5A-5D. In this example, the latch tab 38 has single wing elements 39*a*, 39*b* extending to either side and separated by fold lines 40*a*, 40*b*. The wing elements 39 are separated from the latch leg 15 for insert tab 38, by cut lines 29. In use, wing elements 39*a*, 39*b* are folded inward as shown in FIG. 5B and compressed against latch tab 38 which is in turn folded along crease 26 and inserted into slot 41. The use of single wing elements 39 simplifies the assembly of the folded latch tab 38 with its associated wing elements, reducing the dexterity needed to prepare the latched container.

Figure 6:
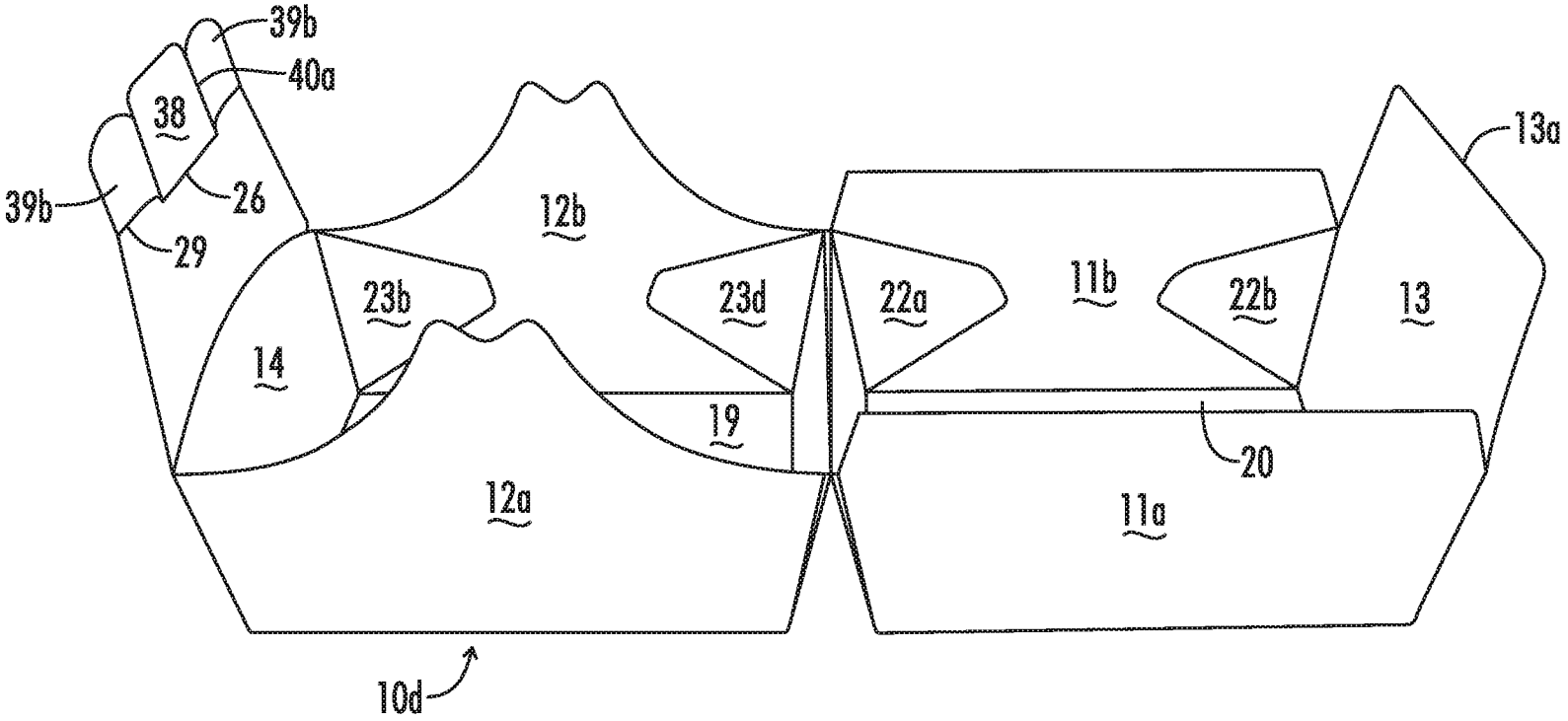
FIG. 6 is a perspective view of a clamshell folding box with the alternative latching tab design of FIG. 5A.

A wing configuration of FIGS. 5A-D is illustrated on a clamshell container 10*d* in FIG. 6. The need for only two fold lines 40*a*, 40*b* simplifies the preparation of both the unitary blank and the actual use of the latching mechanism. In fact, a working latch tab 38 can be made with only a single wing element extending to one side.

Figure 7A:
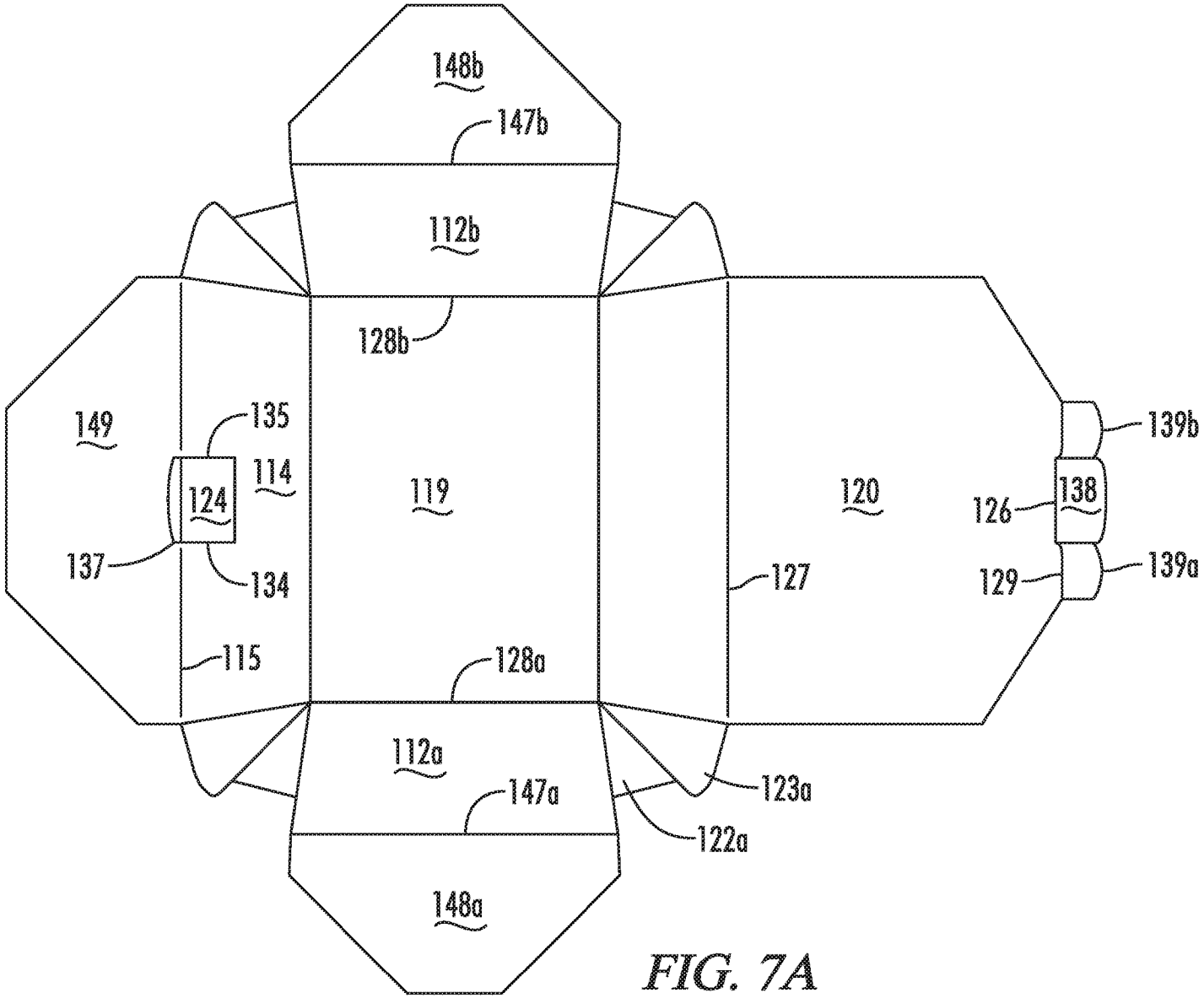
FIG. 7A is a unitary blank for an alternative gusseted food container with a flat top and a latching mechanism according to the disclosure of FIG. 5A.
Figure 7B:
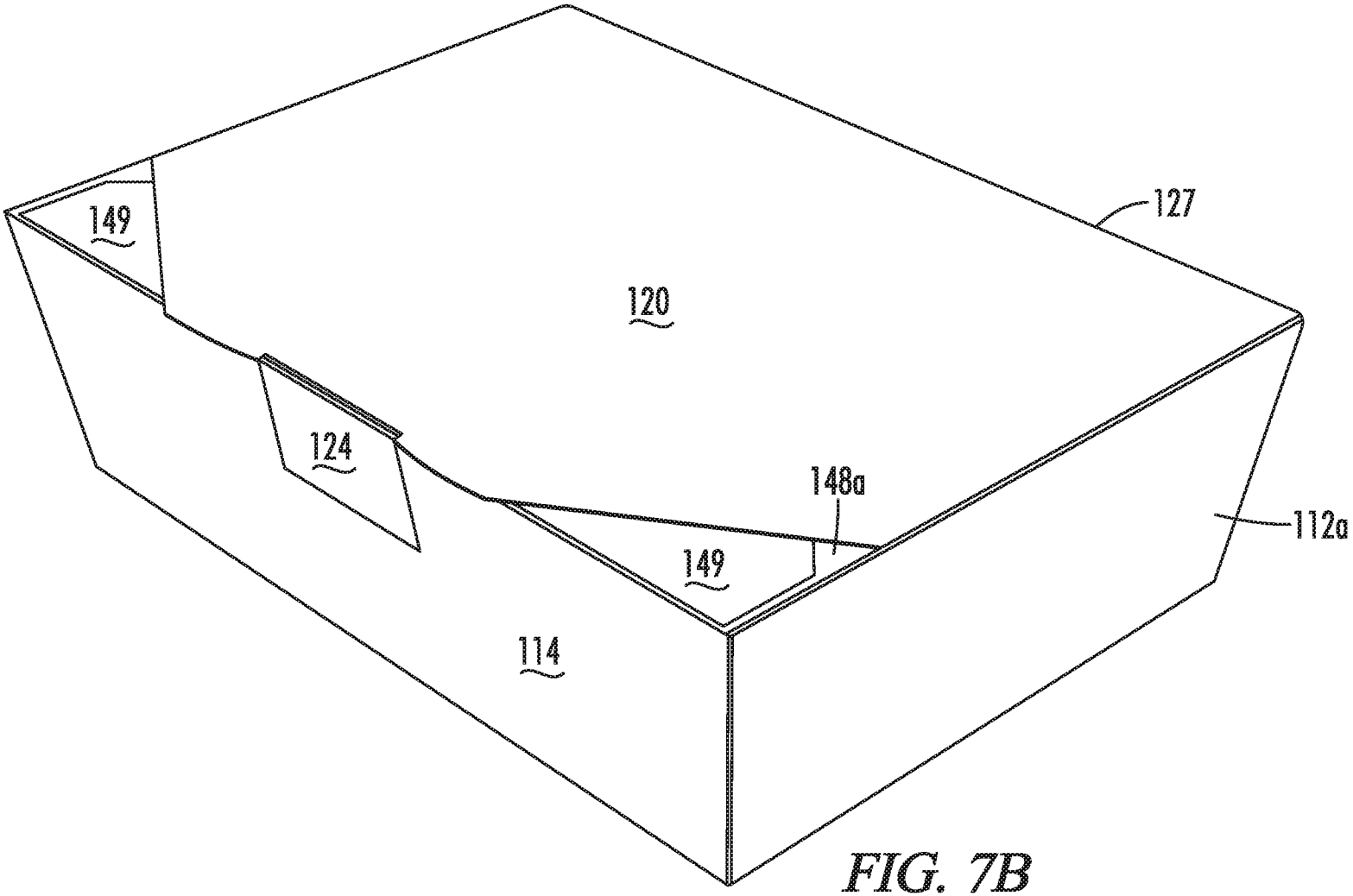
FIG. 7B is a perspective view of a container formed from the blank of FIG. 7A in its latched configuration.

It can also be appreciated that a latching mechanism according to this invention, can be utilized in other container configurations such as box shown in FIGS. 7A, 7B. This box has a flat top panel 120 with the insert tab 138 formed as a forward extension of the top panel 120. This structure uses the fold line 127 that allows the entire top panel 120 to pivot from its rear edge into open and closed positions, to also act as the latch leg and allow for insertion of the latch tab 138 into the slot created along cut line 137. It can be seen that such a box may contain gussets formed by adhering triangular panels 122*a*, 123*a* together, preferably in an inward directed fashion, although exterior gussets are also possible. Side panels 112*a*, 112*b* of the rectangular bottom 119 can be folded inward along creases 128*as*, 128*b* to create sidewalls and then inward facing cover side flaps 148*a*, 148*b* folded inward along creases 147*a*, 147*b* will cover a substantial portion of the storage space within the container. Additional cover is provided by front wall flap 149, that may be folded inward along crease 115 forming the distal edge front panel 114. The illustrated crease 115 also contains cut line 137 that creates the slot ultimately used by insert tab 138 from the folded top 120 as reflected in the assembled configuration of FIG. 7B.

From these examples, it can be seen that the latch tab can be suitably mounted to the front of either a lower tray section or an upper top or crown section of a box. Latch tabs may also be mounted at the tops of side walls to engage with slots along the top side edges of top or crown sections. A single container may have more than one latch according to the invention, for instance, two latches spaced apart along a front of the container, or a latch on each of the left and right sides of the container. The release panel or tear tab should be located either at a top of the container or at the top of a front or side wall of the container, as if perforations for the tear tab were along a bottom or wall bottom, it would engender leakage from the container.

Numerous alterations of the structure and techniques herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

We claim:

1. A container made of a foldable substrate, and said container being of the type having;

a bottom rectangular panel foldably connected to lower edges of a rear wall, opposed sidewalls, and a front wall to form a tray defining a storage area within;

a top having a rear edge hingedly connected to a top edge of the rear wall of the tray;

the top having a top panel with a front edge with a crease line connecting to a front flap section, said crease line having an intermediate section of a cut line defining an opening proximate the path of the crease line;

perforations extending inward from the front edge of the top panel at either end of the cut line;

a fold line connecting ends of the inward extending perforations, said cut line, perforations, and fold line defining a release panel;

the front wall of the tray having a top edge with a crease line connecting to a lower portion of a latch leg;

a latch tab attached along an upper portion of the latch leg, said latch tab having a width defined by one or more crease lines less than the length of the cut line along the front edge of the top panel;

a wing element attached to a side of the latch tab at a crease line and foldable against the latch tab;

wherein the top is a clamshell crown.

2. The container of claim 1 wherein the latch tab has a width defined by a crease along each side, and a wing element attached along each side.

3. The container of claim 1 wherein the wing element attached to the latch tab at a crease line has an opposite crease line defining a second foldably connected wing element.

4. The container of claim 1 wherein gussets connect the ends of the opposed sidewalls to the rear wall and the front wall of the tray.

5. The container of claim 1 wherein the substrate is paperboard.

6. The container of claim 1 wherein the length of the perforations extending downward on the front wall exceeds the length of the latch tab extending from the front edge of the top.

7. A container made of a foldable substrate, and said container being of the type having;

a bottom rectangular panel foldably connected to lower edges of a rear wall, opposed sidewalls, and a front wall to form a tray defining a storage area within;

a top having a rear edge hingedly connected to a top edge of the rear wall of the tray;

the top having a top panel with a side edge with a crease line connecting to a side flap section, said crease line having an intermediate section of a cut line defining an opening proximate the path of the crease line;

perforations extending inward from the side edge of the top panel at either end of the cut line;

a fold line connecting ends of the inward extending perforations, said cut line, perforations, and fold line defining a release panel;

a sidewall of the tray having a top edge with a crease line connecting to a lower portion of a latch leg;

a latch tab attached along an upper portion of the latch leg, said latch tab having a width defined by one or more crease lines less than the length of the cut line along the side edge of the top panel;

a wing element attached to a side of the latch tab at a crease line and foldable against the latch tab.

8. The container of claim 7 wherein the latch tab has a width defined by a crease along each side, and a wing element attached along each side.

9. The container of claim 7 wherein the wing element attached to the latch tab at a crease line has an opposite crease line defining a second foldably connected wing element.

10. The container of claim 7 wherein gussets connect the ends of the opposed sidewalls to the rear wall and the front wall of the tray.

11. The container of claim 7 wherein the substrate is paperboard.

12. The container of claim 7 wherein the length of the perforations extending downward on the front wall exceeds the length of the latch tab extending from the front edge of the top.

* * * * *